US009875708B2

(12) United States Patent
Zou et al.

(10) Patent No.: US 9,875,708 B2
(45) Date of Patent: Jan. 23, 2018

(54) DRIVING CIRCUIT, ARRAY SUBSTRATE AND DISPLAY APPARATUS

(71) Applicants: Xiamen Tianma Micro-Electronics Co., Ltd., Xiamen (CN); Tianma Micro-Electronics Co., Ltd., Shenzhen (CN)

(72) Inventors: Zongjun Zou, Xiamen (CN); Kangpeng Yang, Xiamen (CN); Yumin Xu, Xiamen (CN)

(73) Assignees: XIAMEN TIANMA MICRO-ELECTRONICS CO., LTD., Xiamen (CN); TIANMA MICRO-ELECTRONICS CO., LTD., Shenzhen (CN)

( * ) Notice: Subject to any disclaimer, the term of this patent is extended or adjusted under 35 U.S.C. 154(b) by 189 days.

(21) Appl. No.: 14/853,803

(22) Filed: Sep. 14, 2015

(65) Prior Publication Data

US 2016/0189586 A1 Jun. 30, 2016

(30) Foreign Application Priority Data

Dec. 30, 2014 (CN) ..... 2014 1 0836186

(51) Int. Cl.
*G09G 5/00* (2006.01)
*G09G 3/36* (2006.01)
*G09G 3/3266* (2016.01)

(52) U.S. Cl.
CPC ..... *G09G 3/3677* (2013.01); *G09G 3/3266* (2013.01); *G09G 2310/0283* (2013.01);
(Continued)

(58) Field of Classification Search
CPC ..... G09G 5/006; G09G 5/008; G09G 5/18
See application file for complete search history.

(56) References Cited

U.S. PATENT DOCUMENTS

2010/0158187 A1* 6/2010 Moon ..... G09G 3/3266 377/76
2010/0259525 A1 10/2010 Ohkawa
(Continued)

FOREIGN PATENT DOCUMENTS

CN 1845233 A 10/2006
CN 101217026 A 7/2008
(Continued)

OTHER PUBLICATIONS

Chinese Application No. 201410836186.4, First Office Action dated Aug. 1, 2016.

*Primary Examiner* — Alexander Eisen
*Assistant Examiner* — Mansour M Said
(74) *Attorney, Agent, or Firm* — Alston & Bird LLP

(57) ABSTRACT

A driving circuit is provided, which includes multiple shift register units, at least one scan control unit and at least one all-gate-on unit. An operation of the driving circuit includes a driving phase and a discharging phase. During the driving phase, the at least one scan control unit controls the shift register units to output multiple driving signals successively in a first direction or in a second direction, the first direction being opposite to the second direction. During the discharging phase, the at least one all-gate-on unit controls the shift register units to output multiple driving signals simultaneously. An array substrate and a display apparatus each including the driving circuit are further provided.

17 Claims, 11 Drawing Sheets

(52) U.S. Cl.
CPC ..... *G09G 2310/0286* (2013.01); *G09G 2310/067* (2013.01)

(56) References Cited

U.S. PATENT DOCUMENTS

| | | | | |
|---|---|---|---|---|
| 2011/0148954 | A1* | 6/2011 | Tobita | G09G 3/3688 345/698 |
| 2013/0147697 | A1 | 6/2013 | Sung et al. | |
| 2015/0015558 | A1* | 1/2015 | Sasaki | G09G 3/3677 345/211 |
| 2016/0086562 | A1* | 3/2016 | Tan | G09G 3/3677 345/215 |

FOREIGN PATENT DOCUMENTS

| | | | |
|---|---|---|---|
| CN | 101752004 | A | 6/2010 |
| CN | 101868833 | A | 10/2010 |
| CN | 103165091 | A | 6/2013 |
| CN | 104137170 | A | 11/2014 |
| JP | 2002197885 | A | 7/2002 |
| WO | 2009028353 | A1 | 3/2009 |

* cited by examiner

DRIVING CIRCUIT, ARRAY SUBSTRATE AND DISPLAY APPARATUS

CROSS REFERENCE TO RELATED APPLICATIONS

The present application claims the priority to Chinese Patent Application No. 201410836186.4, entitled "DRIVING CIRCUIT, ARRAY SUBSTRATE AND DISPLAY APPARATUS", filed on Dec. 30, 2014 with the State Intellectual Property Office of People's Republic of China, which is incorporated herein by reference in its entirety.

FIELD OF THE INVENTION

The disclosure relates to the field of display, and in particular, to a driving circuit, an array substrate and a display apparatus.

BACKGROUND OF THE INVENTION

In recent years, display apparatuses are popular and widely applied in, for example, mobile phones, tablet PCs, displays and televisions. A conventional display apparatus includes an array substrate, and the array substrate includes data lines, gate lines, pixel electrodes, and a driving circuit and switching elements which are for coupling the pixel electrodes to the data lines and the gate lines. The driving circuit controls the gate lines to turn on the switching elements, and accordingly, data signals from the data lines are input to the pixel electrodes.

Conventionally, the driving circuit generally drives the gate lines row by row, the switching elements controlled by the gate lines can not be turned on simultaneously, and consequently, the pixel electrodes can not discharge simultaneously, thereby resulting in ghosting and image flutter which may negatively affect display quality and user experience.

BRIEF SUMMARY OF THE INVENTION

A problem to be solved by the disclosure is that, the conventional driving circuit can not drive all the gate lines simultaneously to discharge electric charges, thereby resulting in ghosting and image flutter and influencing display quality and user experience.

A driving circuit is provided according to an embodiment of the disclosure, which includes multiple shift register units, at least one scan control unit and at least one all-gate-on unit. An operation of the driving circuit includes a driving phase and a discharging phase; during the driving phase, the at least one scan control unit controls the shift register units to output multiple driving signals successively in a first direction or in a second direction, the first direction being opposite to the second direction; and during the discharging phase, the at least one all-gate-on unit controls the shift register units to output multiple driving signals simultaneously.

The driving circuit according to the embodiment of the disclosure includes the all-gate-on unit and may enable, based on variations of signals input to clock control terminals, all the driving units to output driving signals, thereby solving the problem in the conventional technology that the driving circuit can not control all the gate lines to turn on switching elements simultaneously to discharge electric charges, avoiding ghosting and image flutter, and improving the display quality.

An array substrate is further provided according to an embodiment of the disclosure, which includes gate lines, data lines and pixel regions arranged in an array and located at intersections of the gate lines and the data lines. The array substrate is provided with at least one driving circuit according to the embodiments of the disclosure.

An array substrate is further provided according to an embodiment of the disclosure, which includes a first clock signal line, a second clock signal line, a third clock signal line, a fourth clock signal line, gate lines, data lines and pixel regions arranged in an array and located at intersections of the gate lines and the data lines. The array substrate is provided with two driving circuits according to the embodiments of the disclosure, which are a first driving circuit and a second driving circuit electrical connections among elements of the array substrate according to the embodiment of the disclosure are detailed as follows:

the first clock signal line is electrically connected to the first clock control terminal of each of odd-numbered stages of driving units of the first driving circuit, the third clock control terminal of each of even-numbered stages of driving units of the first driving circuit, the fourth clock control terminal of each of odd-numbered stages of driving units of the second driving circuit and the second clock control terminal of each of even-numbered stages of driving units of the second driving circuit;

the second clock signal line is electrically connected to the second clock control terminal of each of the odd-numbered stages of driving units of the first driving circuit, the fourth clock control terminal of each of the even-numbered stages of driving units of the first driving circuit, the first clock control terminal of each of the odd-numbered stages of driving units of the second driving circuit and the third clock control terminal of each of the even-numbered stages of driving units of the second driving circuit;

the third clock signal line is electrically connected to the third clock control terminal of each of the odd-numbered stages of driving units of the first driving circuit, the first clock control terminal of each of the even-numbered stages of driving units of the first driving circuit, the second clock control terminal of each of the odd-numbered stages of driving units of the second driving circuit and the fourth clock control terminal of each of the even-numbered stages of driving units of the second driving circuit; and the fourth clock signal line is electrically connected to the fourth clock control terminal of each of the odd-numbered stages of driving units of the first driving circuit, the second clock control terminal of each of the even-numbered stages of driving units of the first driving circuit, the third clock control terminal of each of the odd-numbered stages of driving units of the second driving circuit and the first clock control terminal of each of the even-numbered stages of driving units of the second driving circuit.

A display apparatus is further provided according to an embodiment of the disclosure, which includes the array substrate according to the embodiments of the disclosure and an opposed substrate provided opposite to the array substrate.

The array substrate and the display apparatus according to the embodiments of the disclosure can provide driving signals to all the gate lines simultaneously based on signals input to the clock control terminals, to enable all the pixel electrodes to discharge electric charges, thereby avoiding ghosting and image flutter and improving the display quality.

DETAILED DESCRIPTION OF THE INVENTION

Embodiments of the disclosure are illustrated in detail hereinafter in conjunction with drawings, to further clarify the aforementioned objects, features and advantages of the disclosure.

In order to fully understand the disclosure, many specific details are given in the following description; while the disclosure may be also implemented in other ways different from ways described in the specification, and the disclosure is not limited to the embodiments disclosed hereinafter.

Figure 1A:
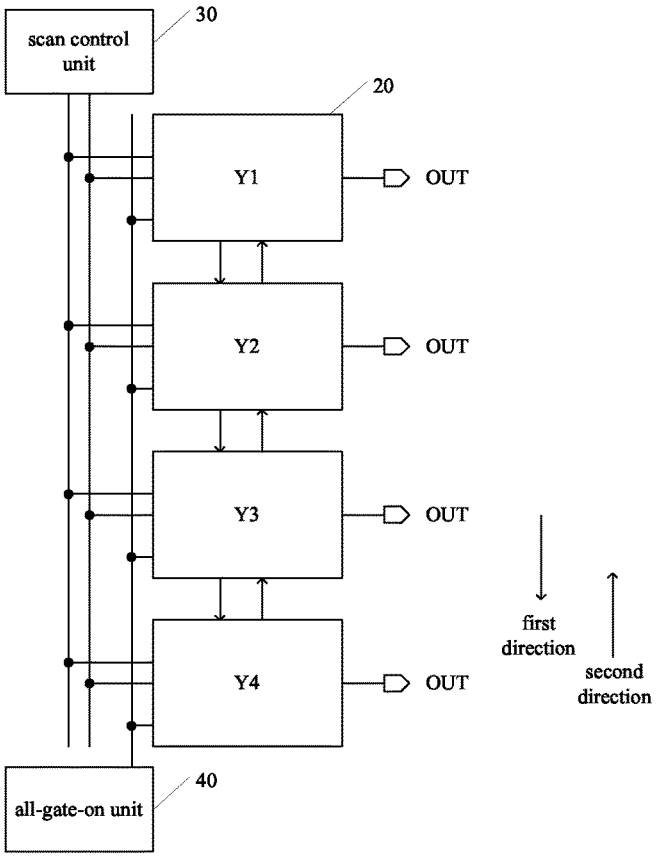
FIG. 1A is a structural diagram of a driving circuit according to an embodiment of the disclosure.
Figure 1B:
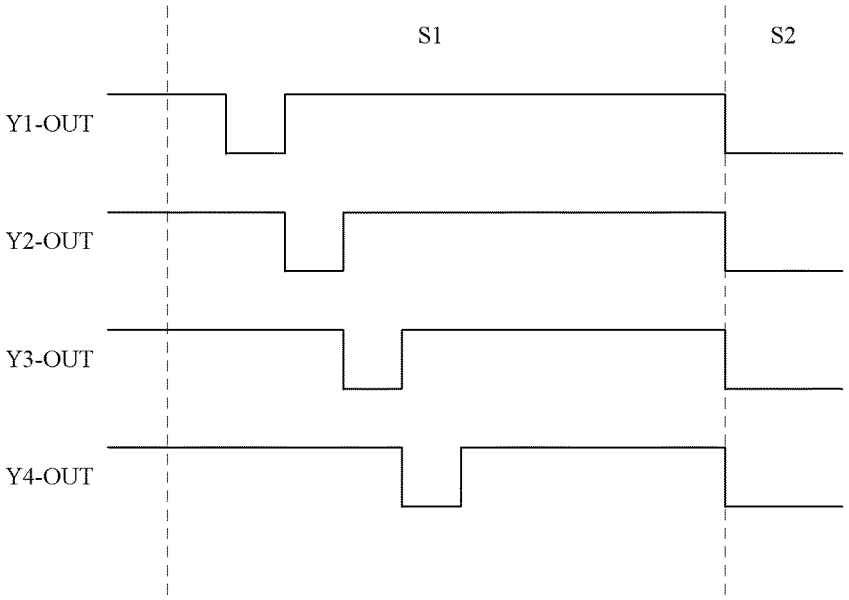
FIG. 1B is a sequence diagram of a driving phase and a discharging phase of the driving circuit in FIG. 1A which drives in a first direction.

A driving circuit is provided according to an embodiment of the disclosure. As shown in FIG. 1A, the driving circuit includes multiple shift register units 20, at least one scan control unit 30 and at least one all-gate-on unit 40. The driving circuit has two operation states of a driving phase S1 and a discharging phase S2 an example of which is illustrated in FIG. 1B.

During the driving phase S1, the scan control unit 30 controls shift register units Y1, Y2, Y3 and Y4 to output multiple driving signals successively in a first direction or a second direction, where the first direction is opposite to the second direction.

During the discharging phase S2, the all-gate-on unit 40 controls the shift register units 20 to output multiple driving signals simultaneously.

The driving signal is a signal of switching elements, which may initiate a driving to maintain the conduction of electricity to perform discharging. The driving signal may be a high level or a low level. Here it is illustrated by taking a low level driving signal as an example in conjunction with FIG. 1B and FIG. 1C. As shown in FIG. 1B, during the driving phase S1, low level signals are successively output in the first direction, i.e., the shift register units Y1, Y2, Y3 and Y4 successively output the low level signals; and during the discharging phase S2, low level signals are simultaneously output from the shift register units Y1, Y2, Y3 and Y4.

Figure 1C:
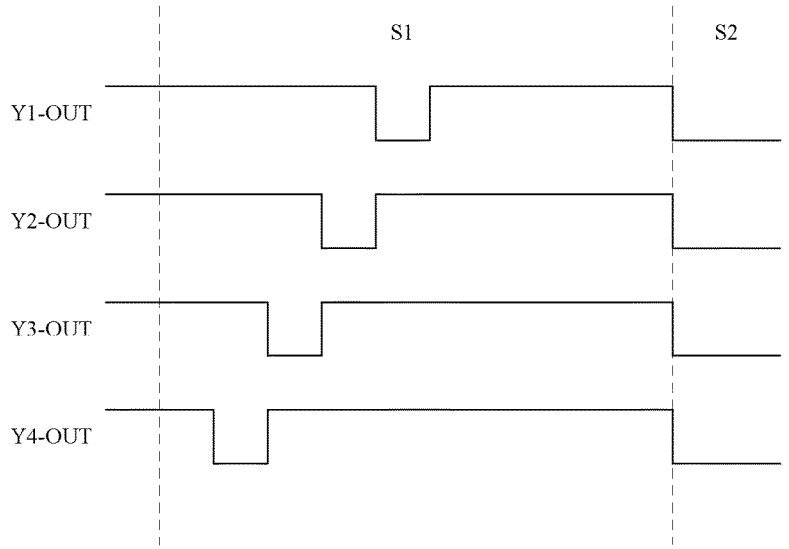
FIG. 1C is a sequence diagram of a driving phase and a discharging phase of the driving circuit in FIG. 1A which drives in a second direction.

As shown in FIG. 1C, during the driving phase S1, low level signals are successively output in the second direction, i.e., the shift register units Y4, Y3, Y2 and Y1 successively output the low level signals; and during the discharging phase S2, low level signals are output from the shift register units Y4, Y3, Y2 and Y1 simultaneously.

It should be noted that, the driving circuit in the embodiment of the disclosure includes multiple transistors, and the driving circuit is formed on a glass substrate, a plastics substrate or an electronic paper substrate rather than located in an integrated circuit or a chip. The driving circuit in the embodiment of the disclosure may perform a normal and ordered driving during the driving phase and may perform a simultaneous driving during the discharging phase, to maintain the conduction of electricity to discharge electric charges, thereby avoiding the ghosting and image flutter.

Figure 2A:
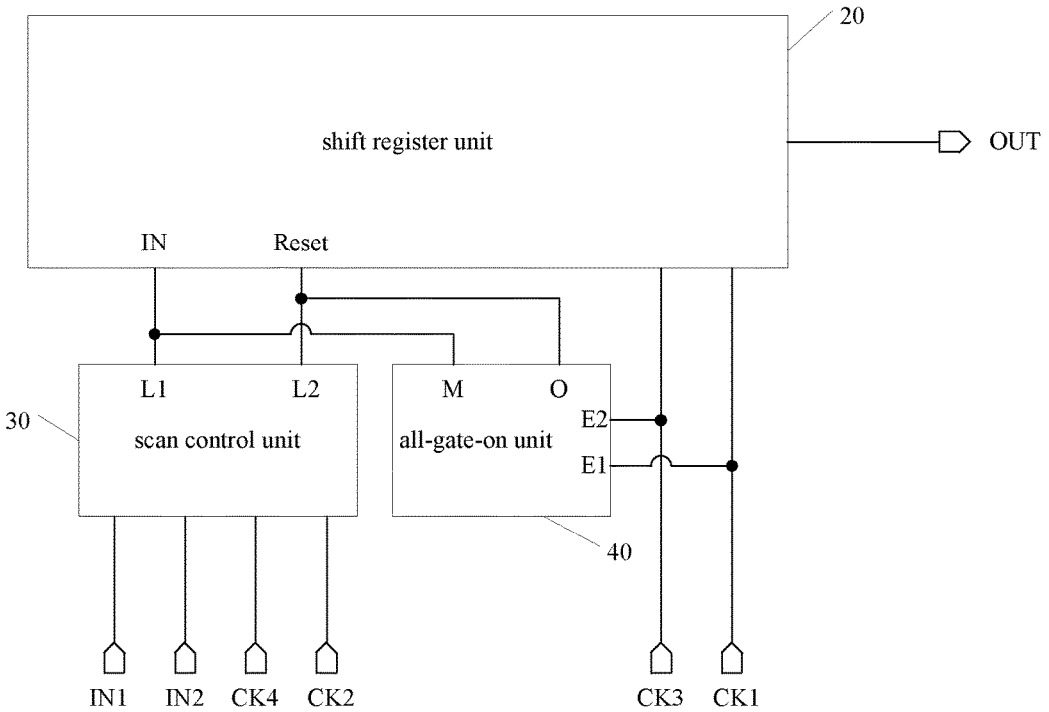
FIG. 2A is a circuit diagram of a driving unit according to an embodiment of the disclosure.
Figure 2B:
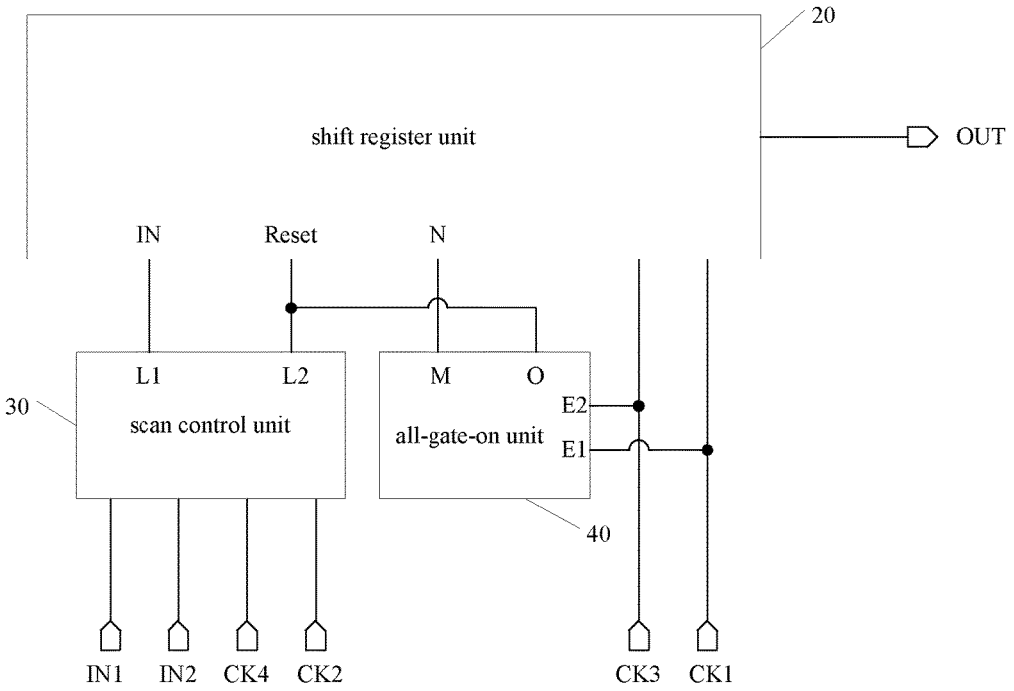
FIG. 2B is a circuit diagram of another driving unit according to an embodiment of the disclosure.

In the disclosure, the number of the shift register units, the number of the at least one scan control unit and the number of the at least one all-gate-on unit may be different or the same. As shown in FIG. 1A, the scan control unit and the all-gate-on unit may control all the shift register units 20 in the driving circuit. Alternatively, as shown in FIG. 2A or FIG. 2B, the number of the shift register units 20, the number of the at least one scan control unit 30 and the number of the at least one all-gate-on unit 40 are the same, and each shift register unit 20 corresponds to one scan control unit 30 and one all-gate-on unit 40. Each scan control unit 30 and each all-gate-on unit 40 control one shift register unit 20, and one shift register unit 20, one scan control unit 30 and one all-gate-on unit 40 form a driving unit 10.

FIG. 2A is a schematic diagram of a circuit of a driving unit 10 provided in the disclosure. The driving circuit further includes a first clock control terminal CK1, a second clock control terminal CK2, a third clock control terminal CK3, a fourth clock control terminal CK4, a first signal input terminal IN1, a second signal input terminal IN2 and an output terminal OUT corresponding to individual shift register unit 20.

The scan control unit 30 includes a first signal output terminal L1 and a second signal output terminal L2. The scan control unit 30 controls the first signal output terminal L1 to output a signal input to the first signal input terminal IN1 or a signal input to the second signal input terminal IN2, and controls the second signal output terminal L2 to output a signal input to the second clock control terminal CK2 or a signal input to the fourth clock control terminal CK4.

The shift register unit 20 includes a trigger signal terminal IN and a reset signal terminal Reset. The trigger signal terminal IN is electrically connected to the first signal output terminal L1 of the scan control unit, and the reset signal terminal Reset is electrically connected to the second signal output terminal L2 of the scan control unit.

The all-gate-on unit 40 is configured to control the shift register unit 20 to continuously output a driving signal. The all-gate-on unit 40 includes a first discharging control terminal E1 and a second discharging control terminal E2. The first discharging control terminal E1 is electrically connected to the first clock control terminal CK1, and the second discharging control terminal E2 is electrically connected to the third clock control terminal CK3.

The all-gate-on unit 40 may be electrically connected to the shift register unit 20 in many ways. FIG. 2A shows one connection way, in which an output terminal M of the all-gate-on unit 40 is electrically connected to the trigger signal terminal IN of the shift register unit 20; accordingly, a signal output from the all-gate-on unit 40 may be output via the shift register unit 20. Or as shown in FIG. 2B, the output terminal M of the all-gate-on unit 40 may be electrically connected to another circuit connection point N of the shift register unit, as long as a potential input to the connection point N may be output from the shift register unit 20. If a driving signal is output directly from the all-gate-on unit 40, the all-gate-on unit 40 may be electrically connected to the output terminal of the shift register unit 20 (i.e., the output terminal of the whole driving unit 10) directly.

It should be noted that, the all-gate-on unit 40 may be further electrically connected to the reset signal terminal Reset of the shift register unit 20. In this way, the all-gate-on unit 40 may reset the circuit regardless of an operation phase of the shift register unit 20. As shown in FIG. 2A and FIG. 2B, a reset control terminal O of the all-gate-on unit 40 is electrically connected to the reset signal terminal Reset of the shift register unit 20.

Figure 3A:
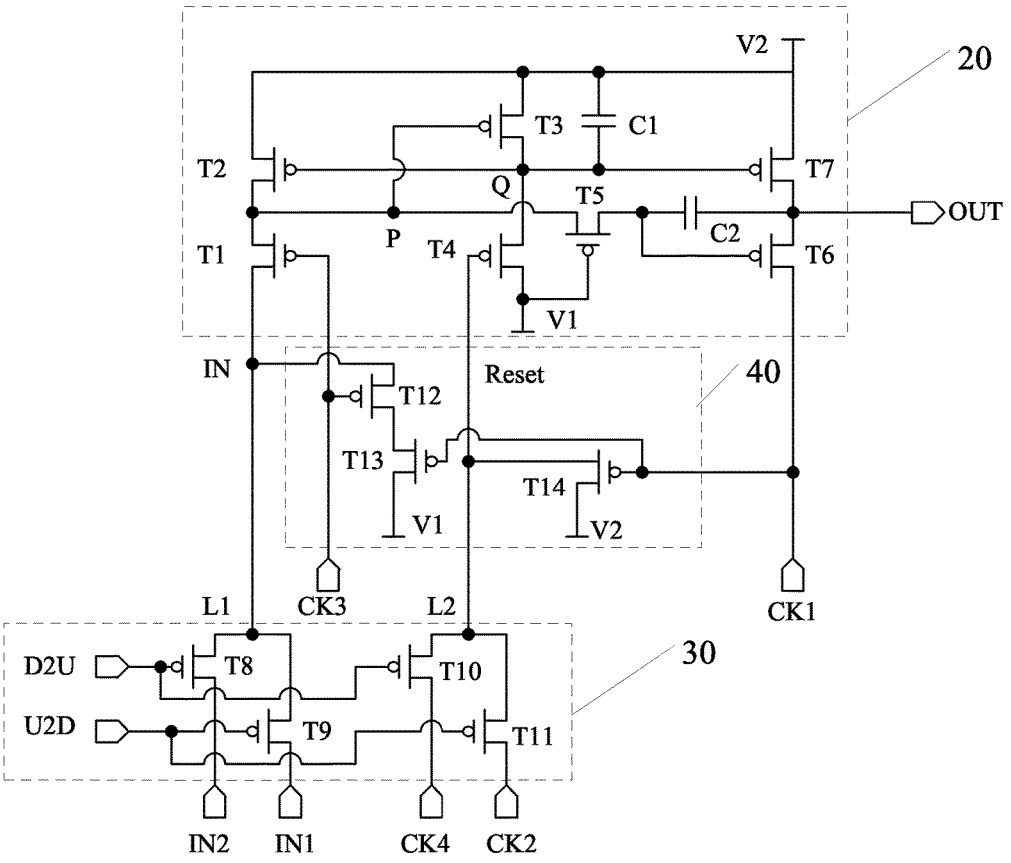
FIG. 3A is a detailed circuit diagram of a driving unit according to an embodiment of the disclosure.

FIG. 3A shows a detailed circuit of a driving unit according to an embodiment of the disclosure. The driving unit 10 includes a shift register unit 20, a scan control unit 30 and an all-gate-on unit 40.

The shift register unit 20 includes a first transistor T1, a second transistor T2, a third transistor T3, a fourth transistor T4, a fifth transistor T5, a sixth transistor T6, a seventh transistor T7, a first capacitor C1, a second capacitor C2, a first voltage supply V1 and a second voltage supply V2.

A gate of the first transistor T1 is electrically connected to a third clock control terminal CK3, a first electrode of the first transistor T1 is electrically connected to a first signal output terminal L1 of the scan control unit, and a second electrode of the first transistor T1 is electrically connected to a second electrode of the second transistor T2 at a point P. A gate of the second transistor T2 is electrically connected to a second electrode of the third transistor T3 at a point Q, a first electrode of the second transistor T2 is electrically connected to a first electrode of the third transistor T3. A gate of the third transistor T3 is electrically connected to the second electrode of the first transistor T1 at the point P.

A gate of the fourth transistor T4 is electrically connected to a second signal output terminal L2 of the scan control unit, a first electrode of the fourth transistor T4 is electrically connected to the first voltage supply V1, and a second electrode of the fourth transistor T4 is electrically connected to the second electrode of the third transistor T3 at the point Q. A gate of the fifth transistor T5 is electrically connected to the first voltage supply V1, a first electrode of the fifth transistor T5 is electrically connected to the second electrode of the first transistor T1 at the point P, and a second electrode of the fifth transistor T5 is electrically connected to a gate of the sixth transistor T6. A first electrode of the sixth transistor T6 is electrically connected to a first clock control terminal CK1, and a second electrode of the sixth transistor T6 is electrically connected to an output terminal OUT of the shift register unit 20.

A gate of the seventh transistor T7 is electrically connected to the second electrode of the third transistor at the point Q. A first electrode of the seventh transistor T7 is electrically connected to the second voltage supply V2, and a second electrode of the seventh transistor T7 is electrically connected to the output terminal OUT of the shift register unit 20. A first plate of the first capacitor C1 is electrically connected to the second voltage supply V2, and a second plate of the first capacitor C1 is electrically connected to the second electrode of the third transistor at the point Q. A first plate of the second capacitor C2 is electrically connected to the second electrode of the fifth transistor T5, and a second plate of the second capacitor C2 is electrically connected to the output terminal OUT of the shift register unit 20.

As shown in FIG. 3A, the san control unit 30 further includes an eighth transistor T8, a ninth transistor T9, a tenth transistor T10, an eleventh transistor T11, a first selection control terminal U2D and a second selection control terminal D2U.

A gate of the eighth transistor T8 is electrically connected to the second selection control terminal D2U, a first electrode of the eighth transistor T8 is electrically connected to a second signal input terminal IN2, and a second electrode of the eighth transistor T8 is electrically connected to the first signal output terminal L1 of the scan control unit 30.

A gate of the ninth transistor T9 is electrically connected to the first selection control terminal U2D, a first electrode of the ninth transistor T9 is electrically connected to a first signal input terminal IN1, and a second electrode of the ninth transistor T9 is electrically connected to the first signal output terminal L1 of the scan control unit 30.

A gate of the tenth transistor T10 is electrically connected to the second selection control terminal D2U, a first electrode of the tenth transistor T10 is electrically connected to a fourth clock control terminal CK4, and a second electrode of the tenth transistor T10 is electrically connected to a second signal output terminal L2 of the scan control unit 30.

A gate of the eleventh transistor T11 is electrically connected to the first selection control terminal U2D, a first electrode of the eleventh transistor T11 is electrically connected to a second clock control terminal CK2, and a second electrode of the eleventh transistor T11 is electrically connected to the second signal output terminal L2 of the scan control unit 30.

As shown in FIG. 3A, the all-gate-on unit 40 may further include a twelfth transistor T12, a thirteenth transistor T13 and a fourteenth transistor T14.

A gate of the twelfth transistor T12 is electrically connected to a third clock control terminal CK3, a first electrode of the twelfth transistor T12 is electrically connected to a second electrode of the thirteenth transistor T13, and a second electrode of the twelfth transistor T12 is electrically connected to a trigger signal terminal IN of the shift register unit 20.

A gate of the thirteenth transistor T13 is electrically connected to the first clock control terminal CK1, and a first electrode of the thirteenth transistor T13 is electrically connected to the first voltage supply V1.

A gate of the fourteenth transistor T14 is electrically connected to the first clock control terminal CK1, a first electrode of the fourteenth transistor T14 is electrically connected to the second voltage supply V2, and a second electrode of the fourteenth transistor T14 is electrically connected to the second signal output terminal L2 of the scan control unit 30.

Figure 3B:
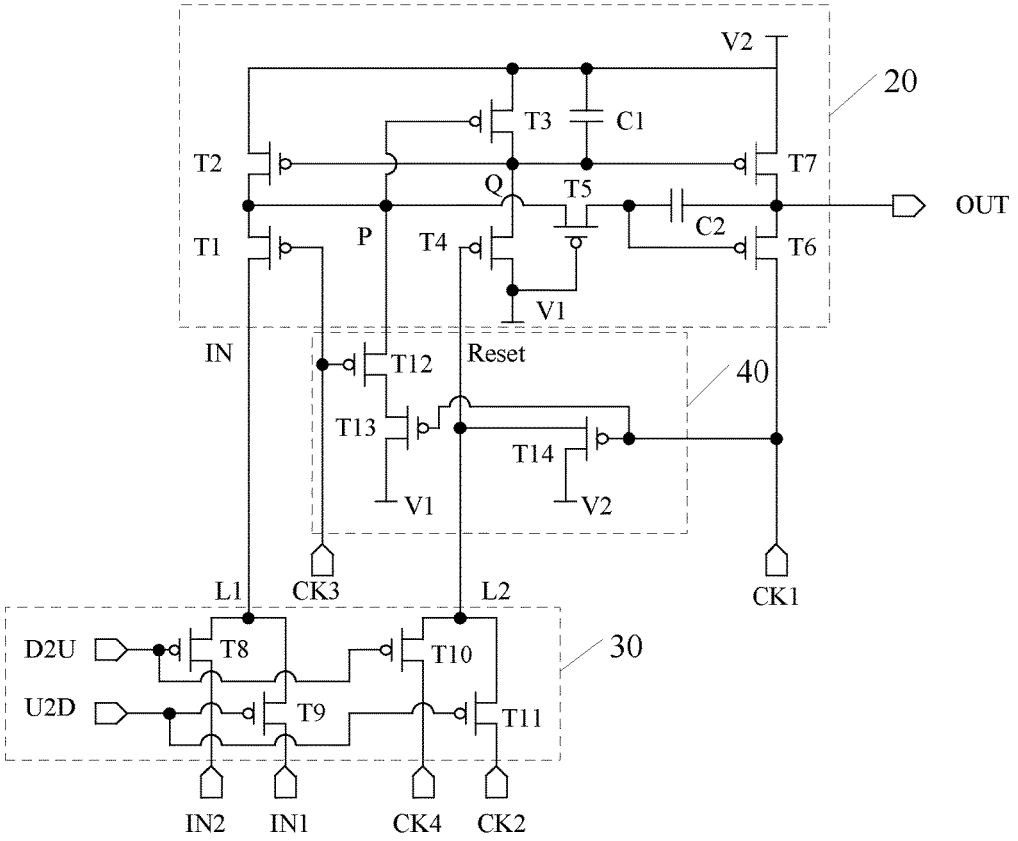
FIG. 3B is a detailed circuit diagram of a driving unit according to an embodiment of the disclosure.

The output terminal of the all-gate-on unit 40 may be connected in many ways. As shown in FIG. 3A, the second electrode of the twelfth transistor T12 is electrically connected to the trigger signal terminal IN of the shift register unit 20; or as shown in FIG. 3B, the second electrode of the twelfth transistor T12 may be electrically connected to the second electrode of the first transistor T1 at the point P. The all-gate-on unit 40 is configured to control the shift register unit 20 to continuously output a driving signal. A connection way between the all-gate-on unit 40 and the shift register unit 20 is not limited, as long as the all-gate-on unit 40 controls the shift register unit 20 to provide a continuous high level or low level under the control of the first clock control terminal CK1 and the third clock control terminal CK3. If the driving signal may be output directly from the all-gate-on unit 40, the all-gate-on unit 40 may be electrically connected to the output terminal of the shift register unit 20, i.e., the output terminal of the whole drive unit, directly.

As shown in FIG. 3A and FIG. 3B, the first transistor T1 to the fourteenth transistor T14 of the driving circuit according to the embodiment of the disclosure each are PMOS (p-channel metal oxide semiconductor) transistors. The first voltage supply V1 supplies a low level potential, and the second voltage supply V2 supplies a high level potential. In other embodiments of the disclosure, the shift register unit 20, the scan control unit 30 and the all-gate-on unit 40 may adopt other circuit structures; NMOS (n-channel metal oxide semiconductor) transistor may be applied, or both the PMOS transistors and the NMOS transistors are applied (i.e., a CMOS (complementary metal oxide semiconductor) structure is adopted).

Figure 4:
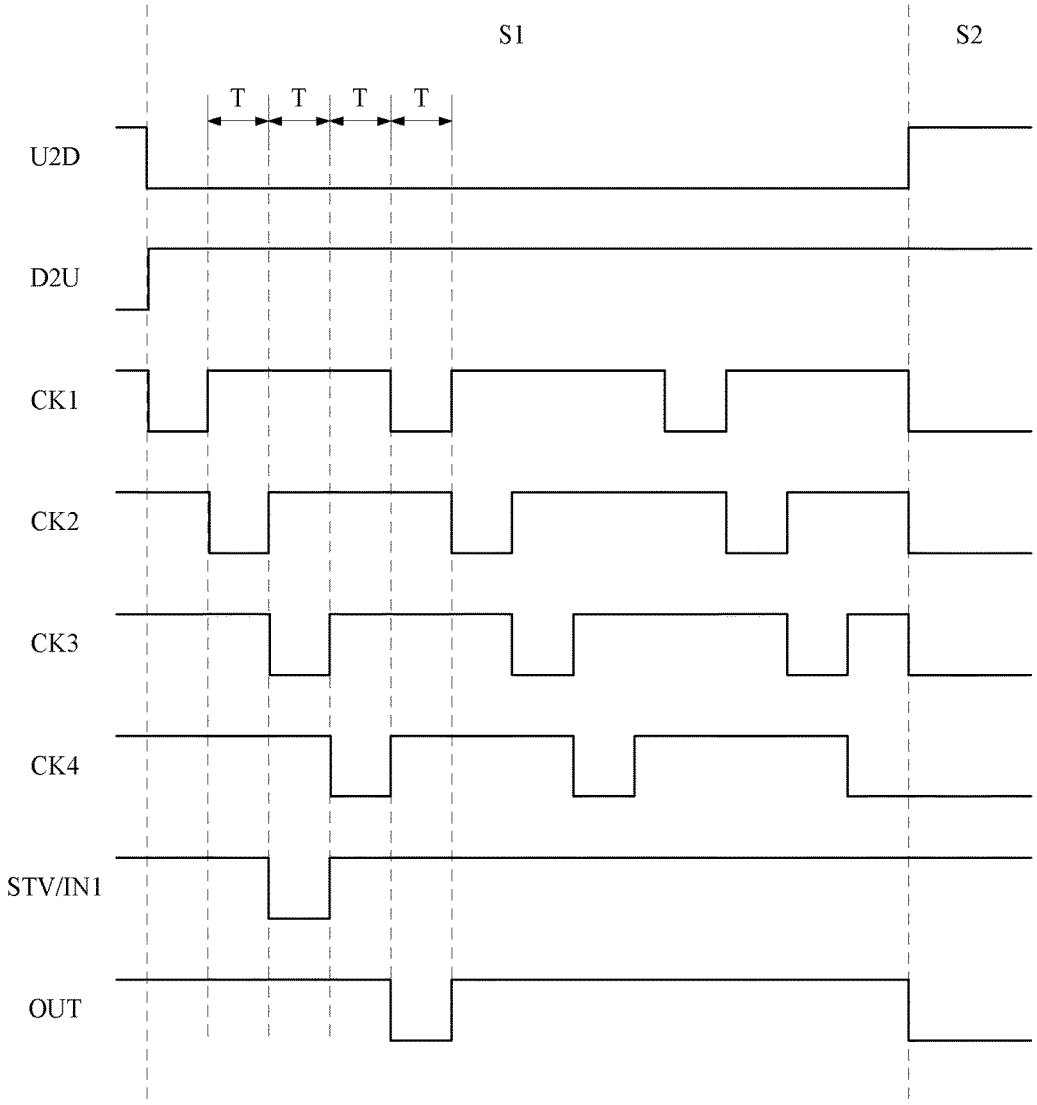
FIG. 4 is a sequence diagram for a driving unit according to an embodiment of the disclosure.

FIG. 4 is a sequence diagram for the circuits shown in FIG. 3A and FIG. 3B, which includes a driving phase S1 and a discharging phase S2.

During the driving phase S1, a first clock signal, a second clock signal, a third clock signal and a fourth clock signal are respectively input to the first clock control terminal CK1, the second clock control terminal CK2, the third clock control terminal CK3 and the fourth clock control terminal CK4. As shown in FIG. 4, the first clock signal to the fourth clock signal have the same period and waveform, while one clock signal is shifted by a time delay of T relative to another clock signal, i.e., the second clock signal is shifted by the time delay of T relative to the first clock signal, the third clock signal is shifted by the time delay of T relative to the second clock signal, and the fourth clock signal is shifted by the time delay of T relative to the third clock signal.

During the driving phase S1, explanation is made based on a case that a low level signal is input to the first selection control terminal U2D and a high level signal is input to the second selection control terminal D2U, i.e., a signal input to the first signal input terminal IN1 is input to the trigger signal terminal IN of the shift register unit 20. In other embodiments of the disclosure, a high level signal may be input to the first selection control terminal U2D and a low level signal may be input to the second selection control terminal D2U, i.e., a signal input to the second signal input terminal IN2 is input to the trigger signal terminal IN of the shift register unit 20.

Reference is further made to FIG. 3A, FIG. 3B and FIG. 4. During a first duration of T, the second clock signal is at a low level, and each of the first clock signal, the third clock signal and the fourth clock signal is at a high level. In the case that a high level is input to the trigger signal terminal IN, the fourth transistor T4 is turned on, the low level from the first voltage supply V1 is input to the point Q to turn on the second transistor T2 and the seventh transistor T7, the high level from the second voltage supply V2 is input to the point P, and a high level is output from the output terminal OUT. The driving circuit is in a reset phase and the first capacitor C1 is charged.

During a second duration of T, the third clock signal is at a low level, and each of the first clock signal, the second clock signal and the fourth clock signal is at a high level. In the case that a low level is input to the trigger signal terminal IN, the first transistor T1 and the twelfth transistor T12 are turned on, and a low level input to the trigger signal terminal IN is input to the point P via the first transistor T1. Since the first clock signal is at the high level, the thirteenth transistor T3 is turned off, and the all-gate-on unit 40 does not influence an input to the trigger signal terminal IN of the shift trigger unit 20. The fifth transistor T5 maintains turned on and the low level signal from the point P is transmitted to the gate of the sixth transistor T6 to turn on the sixth transistor T6, the high level of the first clock signal is output from the output terminal of the shift register unit 20, and the second capacitor C2 is charged.

During a third duration of T, the fourth clock signal is at a low level, and each of the first clock signal, the second clock signal and the third clock signal is at a high level. A high level is input to the trigger signal terminal IN, the first transistor T1 is turned off, and a potential of the point P is maintained at a low level. The fifth transistor T5 maintains turned on and transmits the low level signal from the point P to the gate of the sixth transistor T6 to turn on the sixth transistor T6, and the high level of the first clock signal is output from the output terminal of the shift register unit 20.

During a fourth duration of T, the first clock signal is at a low level, and each of the second clock signal, the third clock signal and the fourth clock signal is at a high level. In the case that a high level is input to the trigger signal terminal IN, the first transistor T1 and the fourth transistor T4 are both turned off, the second capacitor C2 discharges to turn on the sixth transistor T6. The point P is maintained at a low level, the seventh transistor T7 is turned off, and the low level of the first clock signal is output from the output terminal OUT, i.e., the low level signal input to the trigger signal terminal is shifted by a time delay of 2T and output by the shift register unit 20.

Still as shown in FIG. 4, when the driving circuit is at the discharging phase S2, low level signals are input to the first clock control terminal to the fourth clock control terminal, and high level signals are input to the first selection control terminal U2D and the second selection control terminal D2U. None of signals input to the first signal input terminal IN1, the second signal input terminal IN2, the second clock control terminal CK2 and the fourth clock control terminal CK4 of the scan control unit 30 is input to the shift register unit 20, the twelfth transistor T12 and the thirteenth transistor T13 are turned on by low levels input to the first clock control terminal and the third clock control terminal, and the low level of the first voltage supply V1 is input to the shift register unit 20 to turn on the sixth transistor T6. The fourteenth transistor T14 is turned on, and the high level of the second voltage level V2 is input to the gate of the fourth transistor T4 to turn off the fourth transistor. In this case, the low level signal input to the first clock control terminal is output continuously from the output terminal OUT of the shift register unit.

Figure 5:
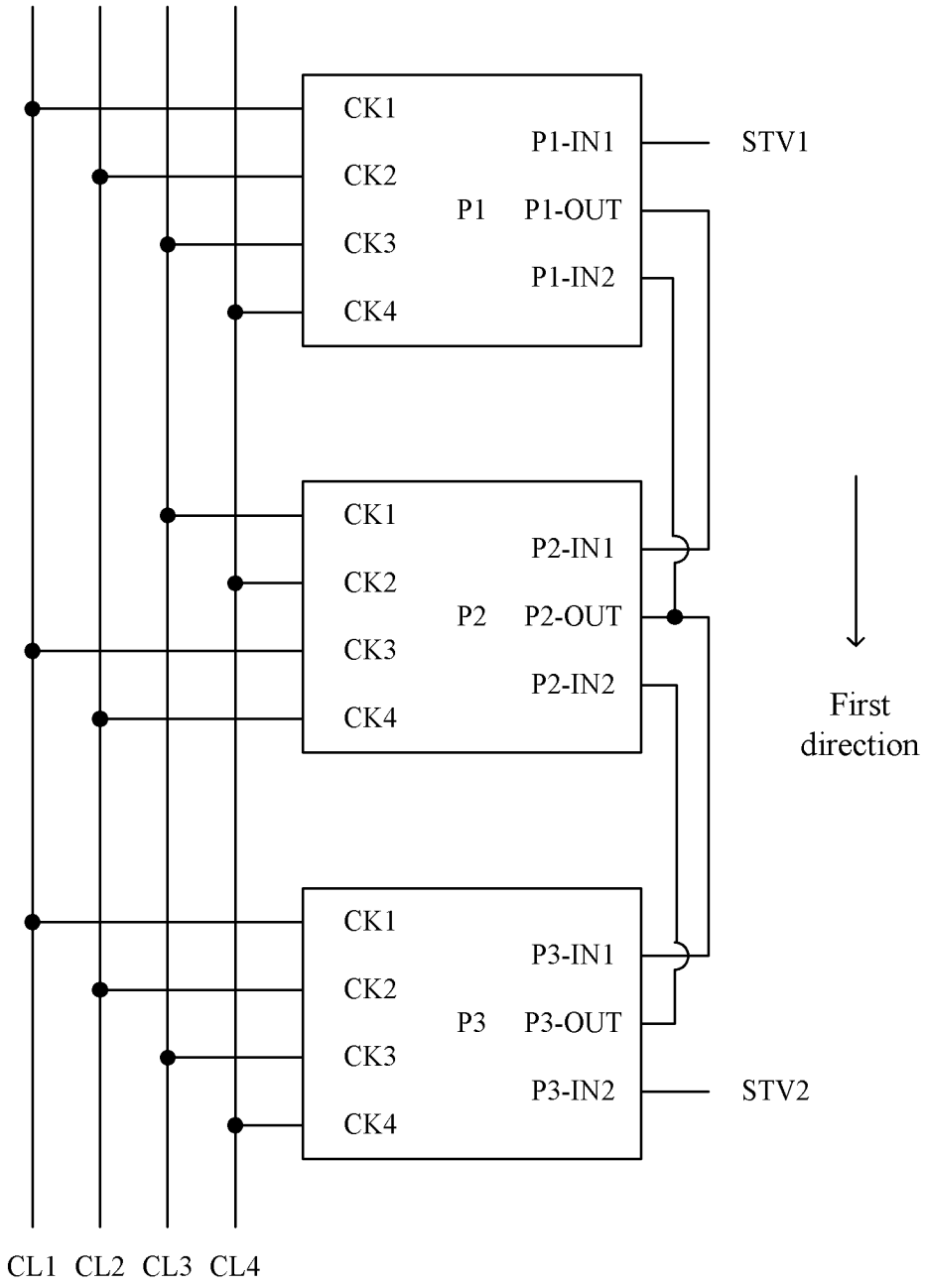
FIG. 5 is a structural diagram of a driving circuit according to an embodiment of the disclosure.

FIG. 5 is a circuit diagram of another driving circuit according to an embodiment of the disclosure. The driving circuit includes multiple driving units P1, P2 and P3 connected stage by stage in a first direction. Output terminals, first signal input terminals and second signal input terminals of respective stages of driving units P1, P2 and P3 are connected in the following way. In the first direction, the output terminal of one stage of driving unit is electrically connected to the first signal input terminal of a next stage of driving unit, for example, in the first direction, an output terminal P1-OUT of a first stage of driving unit P1 is electrically connected to a first signal input terminal P2-IN1 of a second stage of driving unit P2, and an output terminal P2-OUT of the second stage of driving unit P2 is electrically connected to a first signal input terminal P3-IN1 of a third stage of driving unit P3. And in the first direction, the second signal input terminal of one stage of driving unit is electrically connected to the output terminal of a next stage of driving unit, for example, in the first direction, a second signal input terminal P1-IN2 of the first stage of driving unit P1 is electrically connected to the output terminal P2-OUT of the second stage of driving unit P2, and a second signal input terminal P2-IN2 of the second stage of driving unit P2 is electrically connected to an output terminal P3-OUT of the third stage of driving unit P3.

Clock control terminals of the respective stages of driving units are connected in the following way. In the first direction, the first clock control terminal of one stage of driving unit is electrically connected to the third clock control terminal of a next stage of driving unit, i.e., the first clock control terminal CK1 of the first stage of driving unit P1 is electrically connected to the third clock control terminal CK3 of the second stage of driving unit P2, and the first clock control terminal CK1 of the second stage of driving unit P2 is electrically connected to the third clock control terminal CK3 of the third stage of driving unit P3. In the first direction, the second clock control terminal of one stage of driving unit is electrically connected to the fourth clock control terminal of a next stage of driving unit, i.e., the second clock control terminal CK2 of the first stage of driving unit P1 is electrically connected to the fourth clock control terminal CK4 of the second stage of driving unit P2, and the second clock control terminal CK2 of the second stage of driving unit P2 is electrically connected to the fourth clock control terminal CK4 of the third stage of driving unit P3. In the first direction, the third clock control terminal of one stage of driving unit is electrically connected to the first clock control terminal of a next stage of driving unit, i.e., the third clock control terminal CK3 of the first stage of driving unit P1 is electrically connected to the first clock control terminal CK1 of the second stage of driving unit P2, and the third clock control terminal CK3 of the second stage of driving unit P2 is electrically connected to the first clock control terminal CK1 of the third stage of driving unit P3. In the first direction, the fourth clock control terminal of one stage of driving unit is electrically connected to the second clock control terminal of a next stage of driving unit, i.e., the fourth clock control terminal CK4 of the first stage of driving unit P1 is electrically connected to the second clock control terminal CK2 of the second stage of driving unit P2, and the fourth clock control terminal CK4 of the second stage of driving unit P2 is electrically connected to the second clock control terminal CK2 of the third stage of driving unit P3. That is to say, the first clock control terminal CK1 of one driving unit is electrically connected to the third clock control terminal CK3 of an adjacent driving unit, and the second clock control terminal CK2 of one driving unit is electrically connected to the fourth clock control terminal CK4 of an adjacent driving unit.

Reference is made to FIG. 3A, FIG. 3B and FIG. 5. The scan control unit controls the driving circuit to drive in the first direction or in a second direction, where the first direction is opposite to the second direction.

In the case that a driving operation is performed in the first direction, a signal input to the first signal input terminal IN1 is output from the first signal output terminal L1 of the scan control unit 30. An initial signal is input to the first signal input terminal of a scan control unit 30 which firstly occurs in the first direction, i.e., an initial signal STV1 is input to the first signal input terminal P1-IN1 of the first stage of driving unit P1. A signal input to the second clock control terminal CK2 is output from the second signal output terminal L2 of the scan control unit 30.

In the case that a driving operation is performed in the second direction, a signal input to the second signal input terminal IN2 is output from the first signal output terminal L1 of the scan control unit 30. An initial signal is input to the second signal input terminal of a scan control unit 30 which firstly occurs in the second direction, i.e., an initial signal STV2 is input to the second signal input terminal P3-IN2 of the third stage of driving unit P3. A signal input to the fourth clock control terminal CK4 is output from the second signal output terminal L2 of the scan control unit 30.

Figure 6:
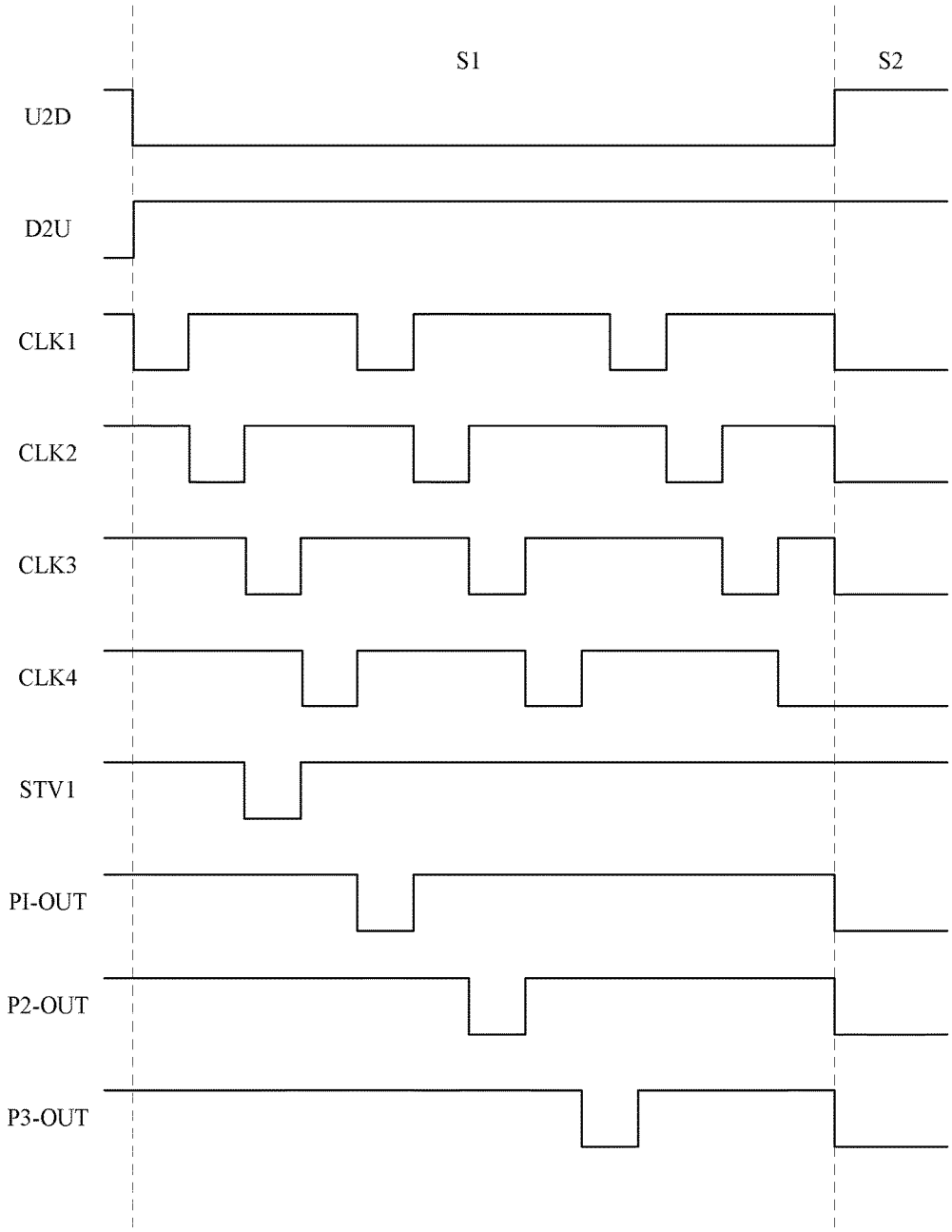
FIG. 6 is a sequence diagram for a driving circuit according to an embodiment of the disclosure.

During the driving phase S1, a first clock signal, a second clock signal, a third clock signal and a fourth clock signal may be respectively provided to the first clock control terminal, the second clock control terminal, the third clock control terminal and the fourth clock control terminal of the driving unit which firstly occurs in the first direction or in the second direction. During the discharging phase, low level signals are input to the first clock control terminal and the third clock control terminal, and high level signals are input to the first selection control terminal and the second selection control terminal. FIG. 6 is a sequence diagram for the driving circuit in FIG. 5 in the case that the driving operation is performed in the first direction. The first clock signal, the second clock signal, the third clock signal and the fourth clock signal are respectively provided to the first clock control terminal CK1, the second clock control terminal CK2, the third clock control terminal CK3 and the fourth clock control terminal CK4 of the first stage of driving unit P1. As shown in FIG. 6, the first clock signal to the fourth clock signal have the same period and waveform, while one clock signal is shifted by a time delay of T relative to another clock signal, i.e., the second clock signal is shifted by the time delay of T relative to the first clock signal, the third clock signal is shifted by the time delay of T relative to the second clock signal, and the fourth clock signal is shifted by the time delay of T relative to the third clock signal.

During the driving phase S1, a low level signal is input to the first selection control terminal U2D, and a high level signal is input to the second selection control terminal D2U. The signal STV1 input to the first signal input terminal P1-IN1 is shifted by a time delay of 2T and output by the first stage of driving unit P1, the signal output from the first stage of driving unit P1 is shifted by the time delay of 2T and output by the second stage of driving unit P2, and the signal output from the second stage of driving unit P2 is shifted by the time delay of 2T and output by the third stage of driving unit P3. That is to say, in the first direction, the signal input to the first signal input terminal IN1 of one stage of driving unit is shifted by the time delay of 2T and output by the stage of driving unit.

In other embodiments of the disclosure, a high level signal may be input to the first selection control terminal U2D and a low level signal may be input to the second selection control terminal D2U, i.e., a signal input to the second signal input terminal IN2 is input to the trigger signal terminal IN of the shift register unit 20. The signal STV2 input to the second signal input terminal P3-IN2 is shifted by a time delay of 2T and output by the third stage of driving unit P3, the signal output from the third stage of driving unit P3 is shifted by the time delay of 2T and output by the second stage of driving unit P2, and the signal output from the second stage of driving unit P2 is shifted by the time delay of 2T and output by the first stage of driving unit P1. That is to say, in the second direction, the signal provided to the first signal input terminal IN2 of one stage of driving unit is shifted by the time delay of 2T and output by the stage of driving unit, thereby performing the driving operation in the second direction.

During the discharging phase S2, similar to the foregoing timing sequence of the driving circuit, low level signals are input to the first clock control terminal to the fourth clock control terminal, and high level signals are input to the first selection control terminal U2D and the second selection control terminal D2U. In this case, none of signals input to the first signal input terminal IN1, the second signal input terminal IN2, the second clock control terminal CK2 and the fourth clock control terminal CK4 of the scan control unit 30 is input to the shift register unit 20, the twelfth transistor T12 and the thirteenth transistor T13 are turned on by low levels input to the first clock control terminal and the third clock control terminal, and the low level of the first voltage supply V1 is input to the shift register unit 20 to turn on the sixth transistor T6. The fourteenth transistor T14 is turned on, and the high level of the second voltage supply V2 is input to the gate of the fourth transistor T4 to turn off the fourth transistor. In this case, the low level signal input to the first clock control terminal is continuously output from the output terminal OUT of the shift register unit.

Figure 7:
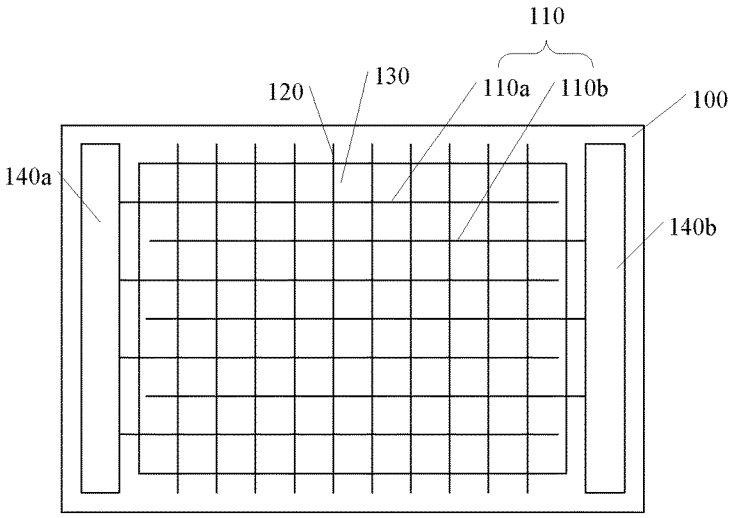
FIG. 7 is a top view of an array substrate according to an embodiment of the disclosure.

An array substrate 100 is further provided according to an embodiment of the disclosure. As shown in FIG. 7, the array substrate 100 includes gate lines 100, data lines 120 and pixel regions 130 arranged in an array and located at intersections of the gate lines 110 and the data lines 120. The array substrate 100 includes at least one driving circuit.

Referring to FIG. 7, the array substrate 100 includes two driving circuits, which are a first driving circuit 140*a* and a second driving circuit 140*b*. The gate lines 110 include first gate lines 110*a* and second gate lines 110*b*. Output terminals of shift register units of the first driving circuit 140*a* are electrically connected to the first gate lines 110*a*, and output terminals of shift register units of the second driving circuit 140*b* are electrically connected to the second gate lines 110*b*.

Furthermore, the first gate lines 110*a* are odd-numbered rows of gate lines arranged parallel in a first direction, and the second gate lines 110*b* are even-numbered rows of gate lines arranged parallel in the first direction.

Figure 8:
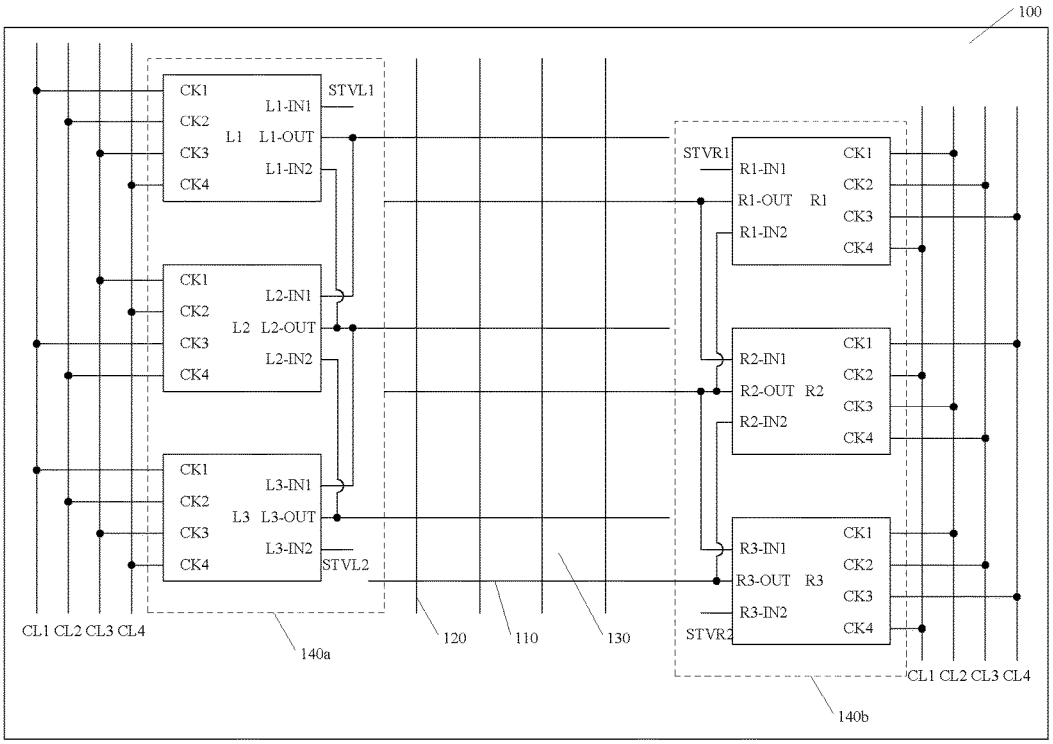
FIG. 8 is a top view of another array substrate according to an embodiment of the disclosure.

An array substrate is further provided according to an embodiment of the disclosure. As shown in FIG. 8, the array substrate includes a first clock signal line CL1, a second clock signal line CL2, a third clock signal line CL3, a fourth clock signal line CL4, gate lines 110, data lines 120 and pixel regions 130 arranged in an array and located at intersections of the gate lines 110 and the data lines 120. The array substrate is provided with two driving circuits, which are a first driving circuit 140*a* and a second driving circuit 140*b*. The first driving circuit 140*a* includes multiple driving units L1, L2 and L3 connected in a first direction, and the second driving circuit 140*b* includes multiple driving units R1, R2 and R3 connected in the first direction.

The first clock signal line CL1 is electrically connected to a first clock control terminal CK1 of each of odd-numbered stages of driving units of the first driving circuit 140*a*, a third clock control terminal CK3 of each of even-numbered stages of driving units of the first driving circuit 140*a*, a fourth clock control terminal CK4 of each of odd-numbered stages of driving units of the second driving circuit 140*b* and a second clock control terminal CK2 of each of even-numbered stages of driving units of the second driving circuit 140*b*. That is, the first clock signal line CL1 is electrically connected to the first clock control terminals CK1 of the driving unit L1 and the driving unit L3, the third clock control terminal CK3 of the driving unit L2, the fourth clock control terminals CK4 of the driving unit R1 and the driving unit R3, and the second clock control terminal CK2 of the driving unit R2.

The second clock signal line CL2 is electrically connected to a second clock control terminal CK2 of each of the odd-numbered stages of driving units of the first driving circuit 140*a*, a fourth clock control terminal CK4 of each of the even-numbered stages of driving units of the first driving circuit 140*a*, a first clock control terminal CK1 of each of the odd-numbered stages of driving units of the second driving circuit 140*b* and a third clock control terminal CK3 of each of the even-numbered stages of driving units of the second driving circuit 140*b*. That is, the second clock signal line L2 is electrically connected to the second clock control terminals CK2 of the driving unit L1 and the driving unit L3, the fourth clock control terminal CK4 of the driving unit L2, the first clock control terminals CK1 of the driving unit R1 and the driving unit R3, and the third clock control terminal CK3 of the driving unit R2.

The third clock signal line CL3 is electrically connected to a third clock control terminal CK3 of each of the odd-numbered stages of driving units of the first driving circuit 140*a*, a first clock control terminal CK1 of each of the odd-numbered stages of the driving units of the first driving circuit 140*a*, a second clock control terminal CK2 of each of the odd-numbered stages of driving units of the second driving circuit 140*b* and a fourth clock control terminal CK4 of each of the even-numbered stages of driving units of the second driving circuit 140*b*. That is, the third clock signal line CL3 is electrically connected to the third clock control terminals CK3 of the driving unit L1 and the driving unit L3, the first clock control terminal CK1 of the driving unit L2, the second clock control terminals CK2 of the driving unit R1 and the driving unit R3, and the fourth clock control terminal CK4 of the driving unit R2.

The fourth clock signal line CL4 is electrically connected to a fourth clock control terminal CK4 of each of the odd-numbered stages of driving units of the first driving circuit 140*a*, a second clock control terminal CK2 of each of the even-numbered stages of driving units of the first driving circuit 140*a*, a third clock control terminal CK3 of each of the odd-numbered stages of driving units of the second driving circuit 140*b*, and a first clock control terminal CK1 of each of the even-numbered stages of driving units of the second driving circuit 140*b*. That is, the fourth clock signal line CL4 is electrically connected to the fourth clock control terminals CK4 of the driving unit L1 and the driving unit L3, the second clock control terminal CK2 of the driving unit L2, the third clock control terminals CK3 of the driving unit R1 and the driving unit R3, and the first clock control terminal CK1 of the driving unit R2.

That is to say, in each of the first driving circuit 140*a* and the second driving circuit 140*b*, the first clock control terminal CK1 of one driving unit is electrically connected to the third clock control terminal CK3 of an adjacent driving unit, and the second clock control terminal CK2 of one driving unit is electrically connected to the fourth clock control terminal CK4 of an adjacent driving unit.

For the first driving circuit 140*a*, the first clock signal line CL1 is electrically connected to the first clock control terminal CK1 of a driving unit which firstly occurs in the first direction, i.e., the driving unit L1; the second clock signal line CL2 is electrically connected to the second clock control terminal CK2 of the driving unit L1; the third clock signal line CL3 is electrically connected to the third clock control terminal CK3 of the driving unit L1; and the fourth clock signal line CL4 is electrically connected to the fourth clock control terminal CK4 of the driving unit L1.

For the second driving circuit 140*b*, the first clock signal line CL1 is electrically connected to the fourth clock control terminal CK4 of a driving unit firstly which occurs in the first direction, i.e., the driving unit R1; the second clock signal line CL2 is electrically connected to the first clock control terminal CK1 of the driving unit R1; the third clock signal line CL3 is electrically connected to the second clock control terminal CK2 of the driving unit R1; and the fourth clock signal line CL4 is electrically connected to the third clock control terminal CK3 of the driving unit R1.

In this way, the timing sequences of the clock control terminals of the driving unit R1, which firstly occurs in the first direction, of the second driving circuit 140*b* are respectively shifted by a time delay of T relative to the timing sequences of corresponding clock control terminals of the driving unit L1, which firstly occurs in the first direction, of the first driving circuit 140*a*, and accordingly, the output of the driving unit R1 of the second driving circuit 140*b* is also delayed with the time delay of T relative to the output of the driving unit L1. Therefore, if driving units of the first driving circuit 140*a* and drive units of the second driving circuit 140*b* are arranged alternately, in the first direction, the low level input to one row of gate line is later than that input to a previous row of gate line by the time delay of T, thereby driving the gate lines row by row.

The array substrate also includes two operation modes of a driving phase S1 and a discharging phase S2. It is explained still with a case that the driving operation is performed in the first direction.

Figure 9:
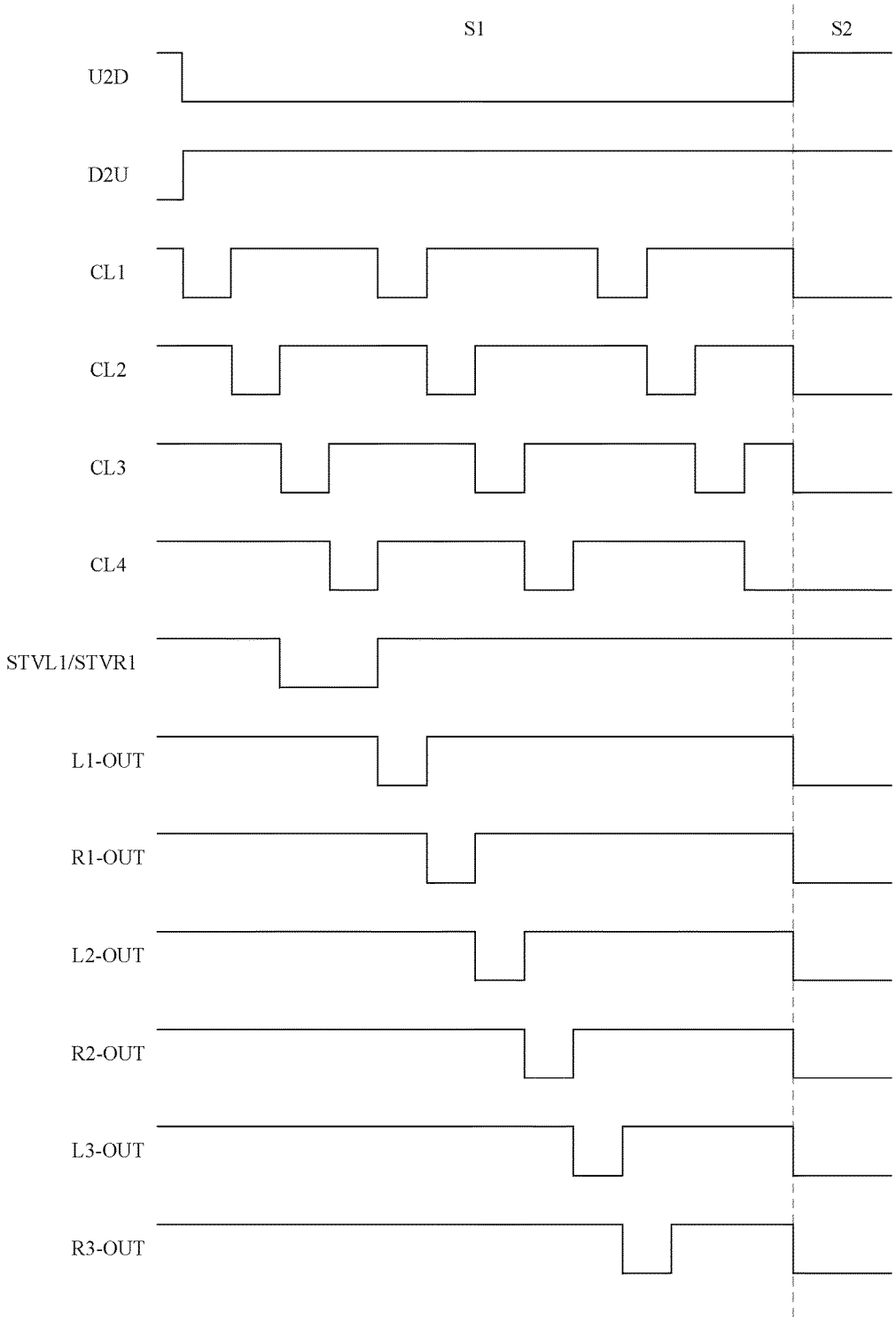
FIG. 9 is a sequence diagram for a circuit in an array substrate according to an embodiment of the disclosure.

During the driving phase S1, a first clock signal, a second clock signal, a third clock signal and a fourth clock signal are respectively input to the first clock signal line CL1, the second clock signal line CL2, the third clock signal line CL3 and the fourth clock signal line CL4. The first clock signal to the fourth clock signal have the same period and waveform, and an (i+1)th clock signal is delayed by a time delay of T relative to an i-th clock signal, where i is a positive integer less than 4. As shown in FIG. 9, the first clock signal to the fourth clock signal have the same period and waveform, while one clock signal is shifted by the time delay of T relative to another clock signal, i.e., the second clock signal is shifted by the time delay of T relative to the first clock signal, the third clock signal is shifted by the time delay of T relative to the second clock signal, and the fourth clock signal is shifted by the time delay of T relative to the third clock signal. Based on the above description of the driving unit and the driving circuit, in the first driving circuit 140*a*, the output of one stage of driving unit is delayed by a time delay of 2T relative to that of a previous stage of driving unit; in the second driving circuit 140*b*, the output of one stage of driving unit is delayed by the time delay of 2T relative to that of a previous stage of driving unit; and the outputs of the respective stages of driving units of the second driving circuit 140*b* are respectively delayed by a time delay of T relative to the outputs of corresponding stages driving units of the first driving circuit 140*a*. An initial signal STVL1 is to be input to the first driving unit L1 of the first driving circuit 140*a*, and an initial signal STVR1 is to be input to the first driving unit R1 of the second driving circuit 140*b*. The two initial signals may be supplied by one STV line. FIG. 9 shows an STV signal having a low level with a width 2T. Alternatively, the first initial input signal STVL1 and the second initial input signal STVR1 may be supplied separately, widths of low levels of the two initial input signals are both T, and the second initial input signal STVR1 is delayed by a time delay of T relative to the first initial input signal STVL1.

During the discharging phase, low level signals are to be input to the first clock control terminal CK1 and the third clock control terminal CK3 of each stage of driving unit of the first driving circuit 140*a* and the second driving circuit 140*b*. For the first driving circuit 140*a*, the first clock signal line CL1 and the third clock signal line CL3 respectively supply signals to the first clock control terminals CK1 and the third clock control terminals CK3; and for the second driving circuit 140*b*, the second clock signal line CL2 and the fourth clock signal line CL4 respectively supply signals to the first clock control terminals CK1 and the third clock control terminals CK3. Hence, during the discharging phase, low level signals are applied to all of the first clock signal line CL1 to the fourth clock signal line CL4, and high level signals are applied to a U2D signal line and a D2U signal line. In this case, based on the above description of the driving unit and the driving circuit, each stage of driving unit continuously outputs a low level signal to a corresponding gate line.

In the above embodiments of the disclosure, it is illustrated with a case that both the driving phase and the discharging phase are triggered by low levels, i.e., the switching elements in the array substrate are turned on by low levels. In other embodiments of the disclosure, both the driving phase and the discharging phase are triggered by high levels, i.e., the switching elements in the array substrate are turned on by high levels. Simple changes made to the transistors and the circuits still fall within the scope of protection of the disclosure.

In the array substrate according to the embodiments of the disclosure, at least one driving circuit may output driving signals simultaneously to discharge electric charges. Particularly, in an alternately-driven array substrate, driving circuits at the left side and the right side control corresponding transistors to turn on simultaneously. In addition, the array substrate according to the embodiments of the disclosure does not need to be provided with extra control lines or extra control signals, thereby simplifying the driving of the panel and solving the problem of the ghosting and image flutter.

Figure 10:
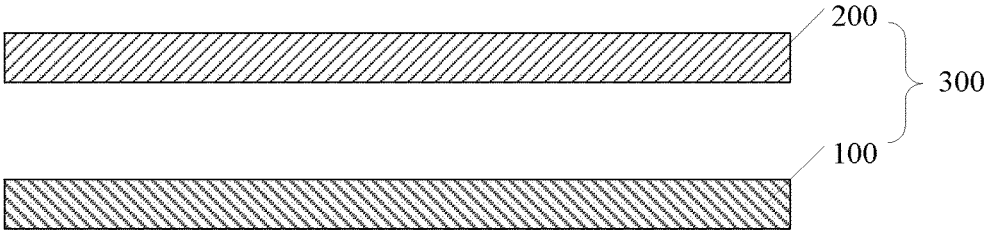
FIG. 10 is a side view of a display apparatus according to an embodiment of the disclosure.

A display apparatus is further provided in the disclosure, which includes the array substrate according to the embodiments of the disclosure and an opposed substrate provided opposite to the array substrate. As shown in FIG. 10, a display apparatus 300 includes an array substrate 100 and an opposed substrate 200. The opposed substrate 200 may be a color film substrate, a glass cover plate or a flexible panel or the like, and the display apparatus 300 may be a liquid crystal display apparatus or an organic light emitting display apparatus or the like.

It should be noted that, the above embodiments may be referred to each other and combined to use. Although the preferred embodiments of the disclosure have been disclosed above, they are not used to limit the disclosure. Those skilled in the art can make possible changes and modifications to the technical solutions of the disclosure by utilizing the disclosed method and technical content without departing from the spirit and scope of the disclosure. Hence, all the simple variations, equivalent changes and modifications made to the above embodiments based on the technical essence of the disclosure without departing from the content of the technical solutions of the disclosure fall within the scope of protection of the technical solutions of the disclosure.

What is claimed is:

1. A driving circuit, comprising: a plurality of driving units, wherein each of the plurality of driving units comprises one shift register unit, one scan control unit, one all-gate-on unit, a first clock control terminal, a second clock control terminal, a third clock control terminal, a fourth clock control terminal, a first signal input terminal, a second signal input terminal and an output terminal;

wherein an operation of the driving circuit comprises a driving phase and a discharging phase;

wherein during the driving phase, the scan control units control the shift register units to successively output a plurality of driving signals in a first direction or in a second direction, wherein the first direction is opposite to the second direction;

wherein during the discharging phase, the all-gate-on units control the shift register units to simultaneously output the plurality of driving signals; and wherein each of the shift register units outputs one of the plurality of driving signals;

wherein the scan control unit comprises a first signal output terminal and a second signal output terminal;

wherein the scan control unit controls the first signal output terminal to output a signal input to the first signal input terminal or a signal input to the second signal input terminal, and controls the second signal output terminal to output a signal input to the second clock control terminal or a signal input to the fourth clock control terminal;

wherein the shift register unit comprises a trigger signal terminal and a reset signal terminal, wherein the trigger signal terminal is electrically connected to the first signal output terminal of the scan control unit, and the reset signal terminal is electrically connected to the second signal output terminal of the scan control unit; and wherein the all-gate-on unit comprises a first discharging control terminal and a second discharging control terminal, wherein the first discharging control terminal is electrically connected to the first clock control terminal, and the second discharging control terminal is electrically connected to the third clock control terminal.

2. The driving circuit according to claim 1, wherein the shift register unit comprises a first transistor, a second transistor, a third transistor, a fourth transistor, a fifth transistor, a sixth transistor, a seventh transistor, a first capacitor, a second capacitor, a first voltage supply and a second voltage supply, wherein a gate of the first transistor is electrically connected to the third clock control terminal, a first electrode of the first transistor is electrically connected to the first signal output terminal of the scan control unit, and a second electrode of the first transistor is electrically connected to a second electrode of the second transistor;

wherein a gate of the second transistor is electrically connected to a second electrode of the third transistor, and a first electrode of the second transistor is electrically connected to a first electrode of the third transistor;

wherein a gate of the third transistor is electrically connected to the second electrode of the first transistor;

wherein a gate of the fourth transistor is electrically connected to the second signal output terminal of the scan control unit, a first electrode of the fourth transistor is electrically connected to the first voltage supply, and a second electrode of the fourth transistor is electrically connected to the second electrode of the third transistor;

wherein a gate of the fifth transistor is electrically connected to the first voltage supply, a first electrode of the fifth transistor is electrically connected to the second electrode of the first transistor, and a second electrode of the fifth transistor is electrically connected to a gate of the sixth transistor;

wherein a first electrode of the sixth transistor is electrically connected to the first clock control terminal, and a second electrode of the sixth transistor is electrically connected to an output terminal of the shift register unit;

wherein a gate of the seventh transistor is electrically connected to the second electrode of the third transistor, a first electrode of the seventh transistor is electrically connected to the second voltage supply, and a second electrode of the seventh transistor is electrically connected to the output terminal of the shift register unit;

wherein a first plate of the first capacitor is electrically connected to the second voltage supply, and a second plate of the first capacitor is electrically connected to the second electrode of the third transistor; and wherein a first plate of the second capacitor is electrically connected to the second electrode of the fifth transistor, and a second plate of the second capacitor is electrically connected to the output terminal of the shift register unit.

3. The driving circuit according to claim 2, wherein the scan control unit further comprises an eighth transistor, a ninth transistor, a tenth transistor, an eleventh transistor, a first selection control terminal and a second selection control terminal;

wherein a gate of the eighth transistor is electrically connected to the second selection control terminal, a first electrode of the eighth transistor is electrically connected to the second signal input terminal, and a second electrode of the eighth transistor is electrically connected to the first signal output terminal of the scan control unit;

wherein a gate of the ninth transistor is electrically connected to the first selection control terminal, a first electrode of the ninth transistor is electrically connected to the first signal input terminal, and a second electrode of the ninth transistor is electrically connected to the first signal output terminal of the scan control unit;

wherein a gate of the tenth transistor is electrically connected to the second selection control terminal, a first electrode of the tenth transistor is electrically connected to the fourth clock control terminal, and a second electrode of the tenth transistor is electrically connected to the second signal output terminal of the scan control unit; and wherein a gate of the eleventh transistor is electrically connected to the first selection control terminal, a first electrode of the eleventh transistor is electrically connected to the second clock control terminal, and a second electrode of the eleventh transistor is electrically connected to the second signal output terminal of the scan control unit.

4. The driving circuit according to claim 3, wherein the all-gate-on unit further comprises a twelfth transistor, a thirteenth transistor and a fourteenth transistor;

wherein a gate of the twelfth transistor is electrically connected to the third clock control terminal, a first electrode of the twelfth transistor is electrically connected to a second electrode of the thirteenth transistor, and a second electrode of the twelfth transistor is electrically connected to the first electrode of the first transistor or the second electrode of the first transistor;

wherein a gate of the thirteenth transistor is electrically connected to the first clock control terminal, and a first electrode of the thirteenth transistor is electrically connected to the first voltage supply; and wherein a gate of the fourteenth transistor is electrically connected to the first clock control terminal, a first electrode of the fourteenth transistor is electrically connected to the second voltage supply, and a second electrode of the fourteenth transistor is electrically connected to the second signal output terminal of the scan control unit.

5. The driving circuit according to claim 4, wherein all transistors from the first to the fourteenth are PMOS transistors, wherein the first voltage supply provides a low level potential, and the second voltage supply provides a high level potential.

6. The driving circuit according to claim 2, wherein the gate of the first transistor is directly connected to the third clock control terminal, the first electrode of the first transistor is directly connected to the first signal output terminal of the scan control unit, and the second electrode of the first transistor is directly connected to the second electrode of the second transistor.

7. The driving circuit according to claim 6, wherein the gate of the second transistor is directly connected to the second electrode of the third transistor, and the first electrode of the second transistor is directly connected to the first electrode of the third transistor;

the gate of the third transistor is directly connected to the second electrode of the first transistor;

the gate of the fourth transistor is directly connected to the second signal output terminal of the scan control unit, the first electrode of the fourth transistor is directly connected to the first voltage supply, and the second electrode of the fourth transistor is directly connected to the second electrode of the third transistor;

the gate of the fifth transistor is directly connected to the first voltage supply, the first electrode of the fifth transistor is directly connected to the second electrode of the first transistor, and the second electrode of the fifth transistor is directly connected to the gate of the sixth transistor;

the first electrode of the sixth transistor is directly connected to the first clock control terminal, and the second electrode of the sixth transistor is directly connected to an output terminal of the shift register unit;

the gate of the seventh transistor is directly connected to the second electrode of the third transistor, the first electrode of the seventh transistor is directly connected to the second voltage supply, and the second electrode of the seventh transistor is directly connected to the output terminal of the shift register unit;

the first plate of the first capacitor is directly connected to the second voltage supply, and the second plate of the first capacitor is directly connected to the second electrode of the third transistor; and the first plate of the second capacitor is directly connected to the second electrode of the fifth transistor, and the second plate of the second capacitor is directly connected to the output terminal of the shift register unit.

8. The driving circuit according to claim 1, wherein the diving units are cascaded in the first direction and each of the driving units outputs one driving signal;

wherein the number of the diving units is N, N is a positive integer greater than or equal to 2, and the N diving units are respectively defined as a $1^{st}$ diving unit to a $N^{th}$ diving unit;

in the first direction, the output terminal of the $k^{th}$ diving unit is electrically connected to the first signal input terminal of the $(k+1)^{th}$ diving unit, and the second signal input terminal of the $k^{th}$ diving unit is electrically connected to the output terminal of the $(k+1)^{th}$ diving unit; and in the first direction, the first clock control terminal of the $k^{th}$ diving unit is electrically connected to the third clock control terminal of the $(k+1)^{th}$ diving unit, the second clock control terminal of the $k^{th}$ diving unit is electrically connected to the fourth clock control terminal of the $(k+1)t^{h}$ diving unit, the third clock control terminal of the $k^{th}$ diving unit is electrically connected to the first clock control terminals of the $(k+1)^{th}$ diving unit, and the fourth clock control terminal of the $k^{th}$ diving unit is electrically connected to the second clock control terminal of the $(k+1)^{th}$ diving unit, wherein k takes each integer value in a range from 1 to N−1, inclusively.

9. The driving circuit according to claim 8, wherein a driving operation is performed in the first direction, a signal input to the first signal input terminal is output from the first signal output terminal of the scan control unit, and wherein a signal input to the second clock control terminal is output from the second signal output terminal of the scan control unit, wherein an initial signal is input to the first signal input terminal of the scan control unit of the $1^{st}$ driving unit; or wherein a driving operation is performed in the second direction, a signal input to the second signal input terminal is output from the first signal output terminal of the scan control unit, and a signal input to the fourth clock control terminal is output from the second signal output terminal of the scan control unit, and an initial signal is an input to the second signal input terminal of the scan control unit of the $N^{th}$ driving unit.

10. The driving circuit according to claim 9, wherein during the driving phase, a first clock signal, a second clock signal, a third clock signal and a fourth clock signal are respectively provided to the first clock control terminal, the second clock control terminal, the third clock control terminal and the fourth clock control terminal of the scan control unit of the $1^{st}$ driving unit or the scan control unit of the $N^{th}$ driving unit;

wherein during the discharging phase, low level signals are input to the first clock control terminal and the third clock control terminal, and high level signals are input to the first selection control terminal and the second selection control terminal.

11. The driving circuit according to claim 10, wherein an (i+1)th clock signal is delayed by time T relative to an i-th clock signal, wherein the first clock signal to the fourth clock signal have identical waveforms and periods, wherein i is 1, 2, or 3.

12. The driving circuit according to claim 11, wherein during the driving phase, the signal input to the first signal input terminal or the signal input to the second signal input terminal is shifted by a time delay of 2T and output by the shift register unit.

13. An array substrate, comprising at least one driving circuit, gate lines, data lines and pixel regions arranged in an array and located at intersections of the gate lines and the data lines;

wherein the driving circuit comprises a plurality of driving units, wherein each of the plurality of driving units comprises one shift register unit, one scan control unit, one all-gate-on unit, a first clock control terminal, a second clock control terminal, a third clock control terminal, a fourth clock control terminal, a first signal input terminal, a second signal input terminal and an output terminal;

wherein an operation of the driving circuit comprises a driving phase and a discharging phase;

during the driving phase, the scan control units control the shift register units to successively output a plurality of driving signals in a first direction or in a second direction, wherein the first direction is opposite to the second direction;

during the discharging phase, the all-gate-on units control the shift register units to simultaneously output the plurality of driving signals; and each of the shift register units outputs one of the plurality of driving signals;

wherein the scan control unit comprises a first signal output terminal and a second signal output terminal; and the scan control unit controls the first signal output terminal to output a signal input to the first signal input terminal or a signal input to the second signal input terminal, and controls the second signal output terminal to output a signal input to the second clock control terminal or a signal input to the fourth clock control terminal;

wherein the shift register unit comprises a trigger signal terminal and a reset signal terminal, wherein the trigger signal terminal is electrically connected to the first signal output terminal of the scan control unit, and the reset signal terminal is electrically connected to the second signal output terminal of the scan control unit; and wherein the all-gate-on unit comprises a first discharging control terminal and a second discharging control terminal, wherein the first discharging control terminal is electrically connected to the first clock control terminal, and the second discharging control terminal is electrically connected to the third clock control terminal.

14. The array substrate according to claim 13, wherein the array substrate is provided with two driving circuits which are a first driving circuit and a second driving circuit, and the gate lines comprise first gate lines and second gate lines; and wherein output terminals of the shift register units of the first driving circuit are electrically connected to the first gate lines; and output terminals of the shift register units of the second driving circuit are electrically connected to the second gate lines.

15. The array substrate according to claim 14, wherein the first gate lines are odd-numbered rows of gate lines arranged in parallel along the first direction, and the second gate lines are even-numbered rows of gate lines arranged in parallel along the first direction.

16. An array substrate, comprising two driving circuits, a first clock signal line, a second clock signal line, a third clock signal line, a fourth clock signal line, gate lines, data lines and pixel regions arranged in an array and located at intersections of the gate lines and the data lines;

wherein the two driving circuits comprise a first driving circuit and a second driving circuit;

wherein each driving circuit comprises a plurality of shift register units, at least one scan control unit and at least one all-gate-on unit;

wherein an operation of each driving circuit comprises a driving phase and a discharging phase;

during the driving phase, the at least one scan control unit controls the shift register units to output a plurality of successive driving signals in a first direction or in a second direction, wherein the first direction is opposite to the second direction; and during the discharging phase, the at least one all-gate-on unit controls the shift register units to output a plurality of driving signals simultaneously;

wherein the number of the shift register units, the number of the at least one scan control unit and the number of the at least one all-gate-on unit are same;

wherein each driving circuit comprises a plurality of driving units, and each of the driving units comprises one of the shift register units, one of the at least one scan control unit and one of the at least one all-gate-on unit;

wherein each driving unit further comprises a first clock control terminal, a second clock control terminal, a third clock control terminal, a fourth clock control terminal, a first signal input terminal, a second signal input terminal and an output terminal;

wherein the scan control unit comprises a first signal output terminal and a second signal output terminal; wherein the scan control unit controls the first signal output terminal to output a signal input to the first signal input terminal or a signal input to the second signal input terminal, and controls the second signal output terminal to output a signal input to the second clock control terminal or a signal input to the fourth clock control terminal;

wherein the shift register unit comprises a trigger signal terminal and a reset signal terminal, wherein the trigger signal terminal is electrically connected to the first signal output terminal of the scan control unit, and the reset signal terminal is electrically connected to the second signal output terminal of the scan control unit;

wherein the all-gate-on unit comprises a first discharging control terminal and a second discharging control terminal, wherein the first discharging control terminal is electrically connected to the first clock control terminal, and the second discharging control terminal is electrically connected to the third clock control terminal;

wherein the first clock signal line is electrically connected to the first clock control terminal of each of odd-numbered stages of driving units of the first driving circuit, the third clock control terminal of each of even-numbered stages of driving units of the first driving circuit, the fourth clock control terminal of each of odd-numbered stages of driving units of the second driving circuit and the second clock control terminal of each of even-numbered stages of driving units of the second driving circuit;

wherein the second clock signal line is electrically connected to the second clock control terminal of each of the odd-numbered stages of driving units of the first driving circuit, the fourth clock control terminal of each of the even-numbered stages of driving units of the first driving circuit, the first clock control terminal of each of the odd-numbered stages of driving units of the second driving circuit and the third clock control terminal of each of the even-numbered stages of driving units of the second driving circuit;

wherein the third clock signal line is electrically connected to the third clock control terminal of each of the odd-numbered stages of driving units of the first driving circuit, the first clock control terminal of each of the even-numbered stages of driving units of the first driving circuit, the second clock control terminal of each of the odd-numbered stages of driving units of the second driving circuit and the fourth clock control terminal of each of the even-numbered stages of driving units of the second driving circuit; and wherein the fourth clock signal line is electrically connected to the fourth clock control terminal of each of the odd-numbered stages of driving units of the first driving circuit, the second clock control terminal of each of the even-numbered stages of driving units of the first driving circuit, the third clock control terminal of each of the odd-numbered stages of driving units of the second driving circuit and the first clock control terminal of each of the even-numbered stages of driving units of the second driving circuit.

17. The array substrate according to claim 16, wherein during the driving phase, a first clock signal, a second clock signal, a third clock signal and a fourth clock signal are respectively input to the first clock signal line, the second clock signal line, the third clock signal line and the fourth clock signal line, the first clock signal to the fourth clock signal have the same period and waveform, and an (i+1)-th clock signal is delayed by a time delay of T relative to an i-th clock signal, wherein i is a positive integer less than 4; and during the discharging phase, low level signals are input to the first clock signal line to the fourth clock signal line, and high level signals are input to the first selection control terminal and the second selection control terminal.

* * * * *